US008584874B2

(12) United States Patent
Russell

(10) Patent No.: US 8,584,874 B2
(45) **Date of Patent: *Nov. 19, 2013**

(54) TAMPER-EVIDENT CLOSURE WITH DIRECTIONAL MOLDED RETENTION TABS

(75) Inventor: Mark N. Russell, Lititz, PA (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/571,449

(22) Filed: Aug. 10, 2012

(65) Prior Publication Data

US 2012/0305517 A1 Dec. 6, 2012

Related U.S. Application Data

(63) Continuation of application No. 11/556,974, filed on Nov. 6, 2006, now Pat. No. 8,302,794.

(60) Provisional application No. 60/745,924, filed on Apr. 28, 2006.

(51) Int. Cl.
*B65D 51/00* (2006.01)
*B65D 53/00* (2006.01)

(52) U.S. Cl.
USPC ..... 215/252; 215/258; 215/344

(58) Field of Classification Search
USPC ..... 215/252, 258, 341, 344
See application file for complete search history.

(56) References Cited

U.S. PATENT DOCUMENTS

| | | | | |
|---|---|---|---|---|
| 4,546,892 | A | 10/1985 | Couput | |
| 5,086,938 | A | 2/1992 | Aichinger | |
| 6,116,442 | A | 9/2000 | Higgins | |
| 6,371,317 | B1 | 4/2002 | Krueger | |
| 6,673,298 | B2 | 1/2004 | Krueger | |
| 6,726,042 | B2 | 4/2004 | Schweigert et al. | |
| 6,729,488 | B2 | 5/2004 | McNary et al. | |
| 7,344,039 | B2 | 3/2008 | Bixler et al. | |
| 7,802,690 | B2 * | 9/2010 | Lohrman et al. | 215/305 |
| 8,302,794 | B2 * | 11/2012 | Russell | 215/252 |
| 2005/0189312 | A1 | 9/2005 | Bixler et al. | |

* cited by examiner

*Primary Examiner* — J. Gregory Pickett
(74) *Attorney, Agent, or Firm* — Barnes & Thornburg LLP

(57) ABSTRACT

A closure is provided for connection to a container. The closure includes a cap and a tamper band. The tamper band includes retention tabs that retain the tamper band to the container.

15 Claims, 7 Drawing Sheets

10
16
18
20
26
38
44
46
76
78
80
82
86
74
45
35
49
26a
26b
43
41

TAMPER-EVIDENT CLOSURE WITH DIRECTIONAL MOLDED RETENTION TABS

CROSS-REFERENCE TO RELATED APPLICATIONS

This application is a continuation of U.S. application Ser. No. 11/556,974, filed Nov. 6, 2006, which claims priority under 35 U.S.C. §119(e) to U.S. Provisional Application Ser. No. 60/745,924, filed Nov. 6, 2006, which is expressly incorporated by reference herein.

BACKGROUND

The present disclosure relates to closures for mounting on the top of bottles or other containers, and in particular, to a closure including a tamper band coupled to a cap of the closure. More particularly, the present disclosure relates to a tamper band that includes retention tabs used to retain the tamper band to the neck of a bottle.

Generally, closures are provided to cover product dispenser openings formed in bottles or other containers. It is known to provide a tamper band that is coupled to the cap portion of the closure by frangible elements. If the tamper band is separated from the cap before a consumer purchases a bottle or container, then the consumer is put on notice that someone may have tampered with the bottle and gained unauthorized access to the product stored in the bottle through the opening, normally covered by the closure. Once the tamper band is separated from the cap, the band remains positioned around the neck of the bottle until removed by the consumer.

SUMMARY

According to the present disclosure, a tamper-evident closure comprises a cap and a tamper band coupled to the cap of the closure. The tamper band is coupled to the cap by frangible elements. The tamper band includes retention tabs that hold the tamper band onto the neck of a bottle or container. The tamper band is used as a security measure to alert consumers that the cap has been removed previously from the container in the event that the tamper band is separated from the cap. Separating the cap tamper band, for example, by breaking the frangible elements, it will become apparent to the consumer that the cap has been removed previously from the bottle.

In the illustrative embodiments, the retention tabs of the tamper band are molded to extend inwardly and upwardly in the "direction of use." That is, the retention tabs are molded to extend in "inward and upward" directions from a circular lower edge of a cap side wall toward a cap ceiling to lie in an interior region of the cap bounded by the cap side wall and ceiling. The retention tabs are arranged to lie in such an "in-use" position both when molded and when the closure is mounted on the neck of a bottle. By molding the retention tabs in their in-use position, the amount of damage to the retention tabs is limited when removing the closure from a mold or installing the closure on a bottle.

The tamper-evident closure is formed in a multi-part mold. The mold is designed to allow the retention tabs of the tamper band to be molded in their in-use positions. During the release of the tamper-evident closure from the mold, the retention tabs "flex" downward to clear the mold core and "snap back" to assume their molded in-use positions extending upwardly into the interior region of the cap once the closure is released from the mold. During installation of the tamper-evident closure onto a bottle, the retention tabs pivot upwardly to clear the threads of the bottle. By molding the retention tabs in an upward direction, it is unnecessary to fold or pivot the tabs in a secondary stage of production.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
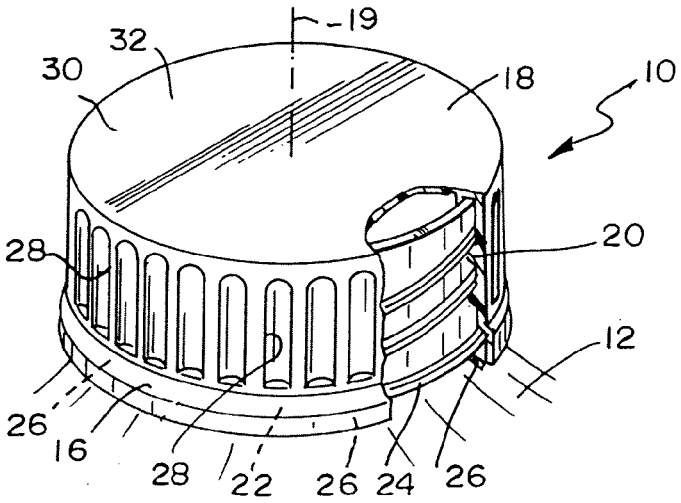
FIG. 1 is a perspective view of a tamper-evident closure in accordance with the present disclosure, with portions broken away, showing the tamper-evident closure mounted on a bottle to cover a mouth opening into an interior region formed in the bottle and showing a cap and a tamper band coupled to a bottom of the cap, the cutaway revealing internal threads formed on an interior side wall of the cap engaging external threads formed on a neck of the bottle and further revealing one of the directionally molded retention tabs included in the tamper band (shown in more detail in FIG. 3) extending inwardly and upwardly to engage the neck of the bottle.
Figure 9:
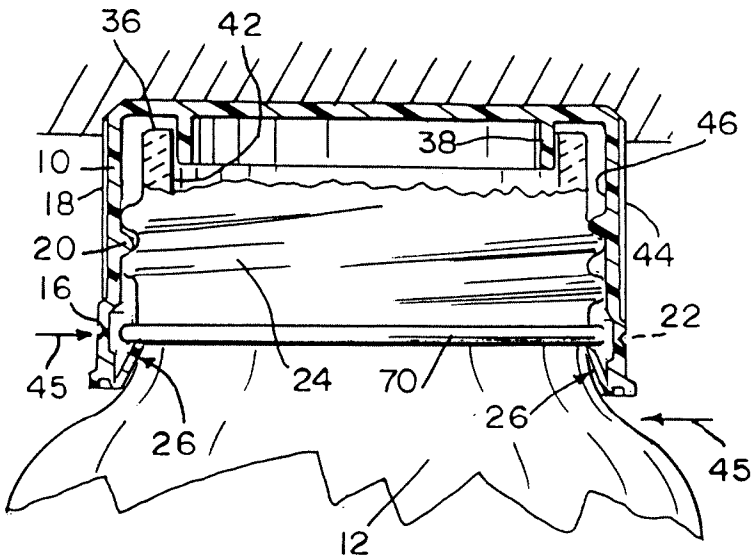
FIG. 9 is a sectional view similar to FIGS. 7 and 8 showing the tamper-evident closure after installation onto the neck of the bottle wherein the side wall of the cap has returned to its original position and the retention tabs of the tamper band have pivoted inwardly under the annular lip of the bottle neck.
Figure 13:
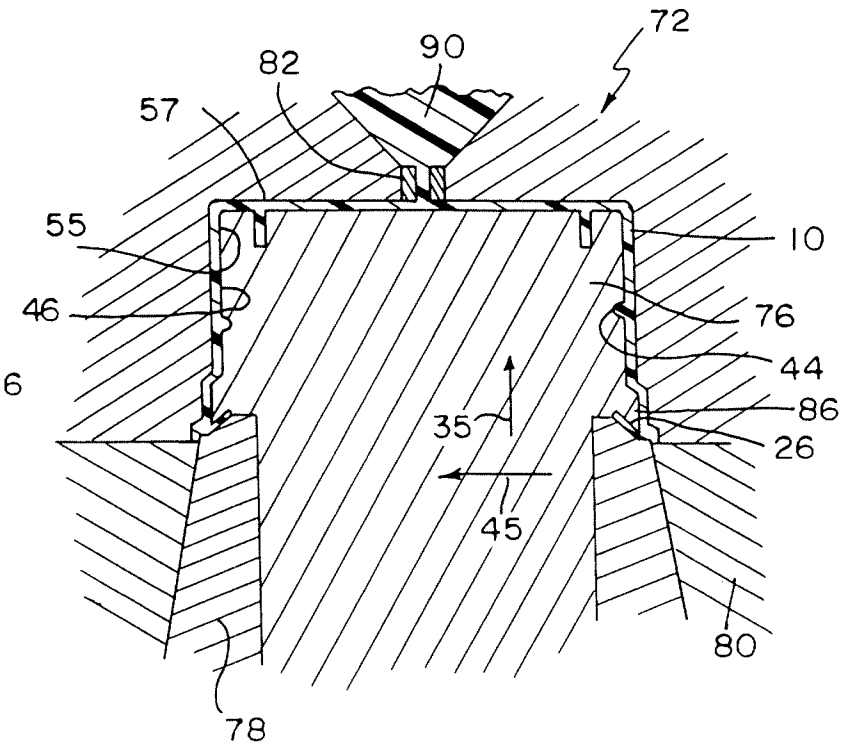
FIG. 13 is a sectional view similar to FIG. 12 showing plastics material being injected into the mold to fill the mold cavity including portions of the mold that form the retention tabs of the tamper band.

A tamper-evident container closure 10 is configured to be coupled to a neck 24 of a bottle 12 and formed to include a tamper band 16 provided with retention tabs 26 as shown in FIG. 1. Retention tabs 26 are molded to extend in upward direction 35 toward a ceiling or top wall 30 of cap 18 to assume molded "in-use" positions, as shown, for example, in the illustrative embodiment of FIGS. 6 and 13. Container closure 10 includes a cap 18 coupled to tamper band 16 and adapted to be secured to bottle 12 as shown in FIG. 9. Once container closure 10 is secured to bottle 12, cap 18 can be twisted off of bottle 12, as indicated by arrow 37 in the illustrative embodiment of FIG. 10. Twisting cap 18 from the bottle 12 causes the breakage of frangible elements 22, separating cap 18 from tamper band 16. Retention tabs 26 are molded to extend in an upward direction toward cap ceiling 30 by using a multi-part mold, shown, for example, in FIG. 12. Retention tabs 26 are designed to automatically rotate back to their approximate original molded position after container closure 10 is removed from the mold. Auto rotation of retention tabs 26 is accomplished by the elasticity of the plastics material used to mold closure 10 and surface geometry and curvature of retention tabs 26.

Tamper-evident container closure 10 is adapted for mounting on bottle 12 to cover an opening 14 into an interior region formed in bottle 12, as shown, for example, in FIG. 1. Tamper-evident container closure 10 includes cap 18 and tamper band 16 is secured to cap 18. Tamper band 16 is connected to cap 18 by frangible elements 22. To remove cap 18 of closure 10 from bottle 12, rotational force must be exerted on cap 18 about axis of rotation 19 to break frangible elements 22, as suggested in FIGS. 1 and 2. Force used to remove cap 18 from bottle 12 results in tamper band 16 permanently separating from cap 18, thus putting the consumer on notice that bottle 12 may have been subject to tampering. Tamper band 16 remains positioned around neck 24 of bottle 12 even after cap 18 is removed from bottle 12 as suggested in FIG. 2.

Tamper band 16 is retained on neck 24 of bottle 12 by means of a plurality of directionally molded retention tabs 26. Retention tabs 26, as best shown in the illustrative embodiments of FIGS. 3-6, are spaced about an inner perimeter of tamper band 16 and are molded so that retention tabs 26 extend radially inwardly and axially upwardly in direction 35 to engage the neck 24 of bottle 12 properly. Retention tabs 26 are directionally molded in their in-use position to reduce the likelihood of damage to living hinges 62 that connect retention tabs 26 to tamper band 16, and to orient retention tabs 26 properly without requiring any intermediary manufacturing step of mechanically repositioning retention tabs 26 prior to use.

Figure 6:
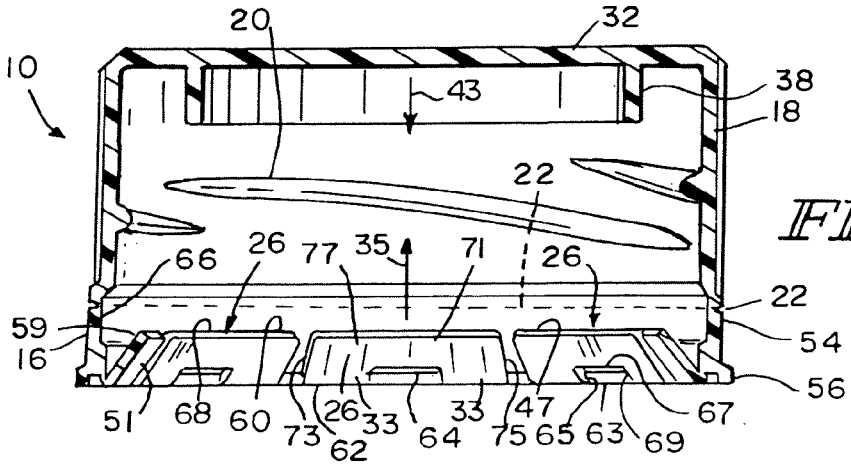
FIG. 6 is a sectional view of the tamper closure taken along line 6-6 of FIG. 4 showing the retention tabs of the tamper band oriented in their molded in-use positions, extending upwardly and inwardly from the lower edge of the tamper band and further showing a tear line of separation between the cap and the tamper band established by the frangible elements as indicated by a phantom line.

Retention tabs 26 are molded with tamper band 16 and are connected by living hinges 62, as shown, for example, in FIG. 6, which permits tabs 26 to be flexed in downward direction 43. Hinges 62 provide a retainer means for retaining retention tabs 26 to tamper band 16 in their in-use position and to permit retention tabs 26 to flex downwardly so that retention tabs 26 can pivot out from beneath inner mold core 76 during ejection of closure 10 from the mold and automatically pivot back to the molded in-use position upon clearing inner mold core 76 without requiring an intermediary manufacturing step of manually repositioning retention tabs 26 from a flexed position to the molded in use position prior to use. Retention tabs 26 are molded at approximately 40 degrees from vertical. Hinges 62 are constructed of a material having an elasticity to allow retention tabs 26 to flex downwardly and return to their molded in-use positions. Retention tabs 26 also include bridge members 33 that extend from living hinges 62. Bridge members 33 are separated by slot 64 that is defined by walls 63, 65, 67, and 69. Bridge members 33 are interconnected by top member 71. Top member 71 includes edge 68 that forms free end 47. Edge 68 is arcuate shaped and configured to provide means to conform to the neck 24 of the container 12. Edge 68 has a thickness that is about equal to a maximum thickness of retention tabs 26. Retention tabs 26 also includes first and second sides 77, 79, as shown, for example, in FIG. 5. Retention tabs 26 are curved toward first side 77, which allows retention tabs 26 to conform to the diameter of neck 24 of bottle 12.

Cap 18 of tamper-evident closure 10, as shown in the illustrative embodiments of FIGS. 1-6, is a molded structure having an annular side wall 28 provided with internal threads 20 and a generally planar top wall 30. Each internal thread 20 has an arc length 21 as suggested in FIG. 2. Cap 18, of tamper-evident closure 10, can be designed to fit bottles and containers of various sizes such as containers that store solid and liquid products. Top wall 30 of cap 18 includes an exterior side 32 and an interior side 34 as suggested in FIGS. 1 and 2. Interior side 34 of top wall 30 is adapted to engage a top edge 36 of bottle 12. Interior side 34 of top wall 30 also includes an annular plug 38 that extends downwardly in direction 43 from interior side 34 of top wall 30, as suggested in FIG. 6. Plug 38 includes an exterior side surface 40 that is adapted to engage an interior side wall 42 of neck 24 as suggested in FIG. 9. Plug 38 is designed to seal the contents of bottle 12.

Figure 2:
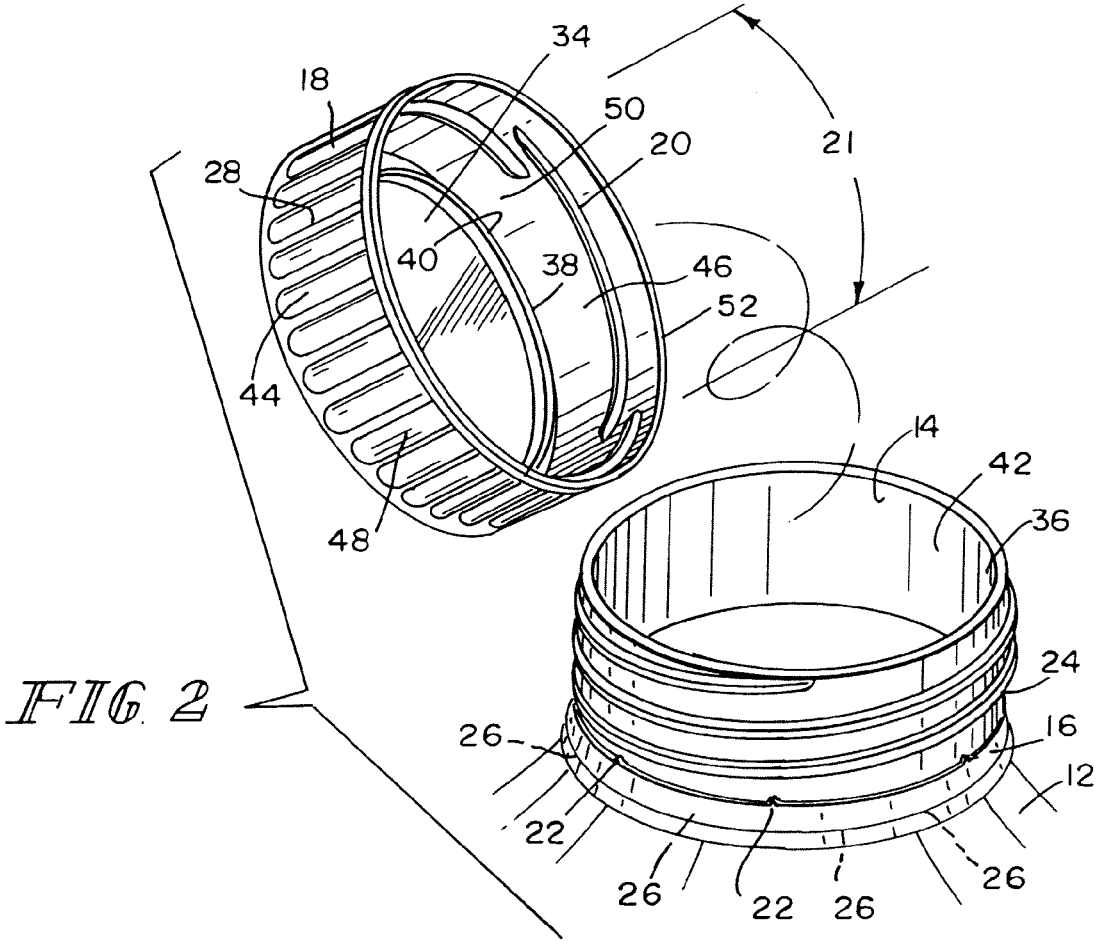
FIG. 2 is a perspective view of the tamper-evident closure of FIG. 1, separated from the bottle by rotational movement of the cap with respect to the bottle, showing the tamper band, previously connected to the cap by frangible elements, separated from the cap and retained on the neck of the bottle.
Figure 3:
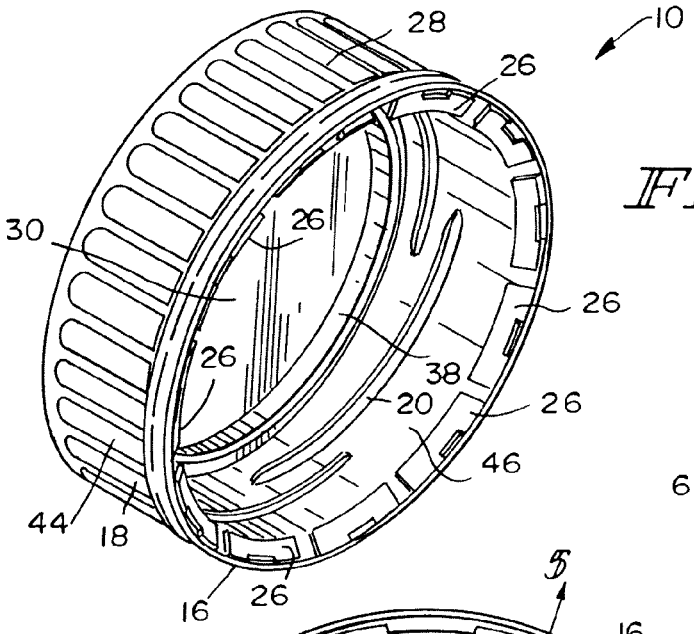
FIG. 3 is a perspective view of the tamper-evident closure of FIGS. 1 and 2, as it would appear after being removed from the mold, showing the internal threads on the interior side wall of the cap and further showing the directionally molded retention tabs of the tamper band in their molded in-use positions extending radially inward and upward from a lower edge of the tamper band.
Figure 5:
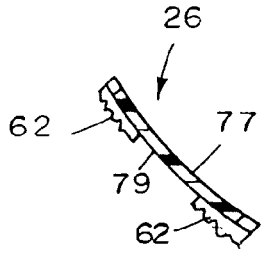
FIG. 5 is a sectional view taken along line 5-5 of FIG. 4 and showing the retention tab and a portion of the living hinge.
Figure 4:
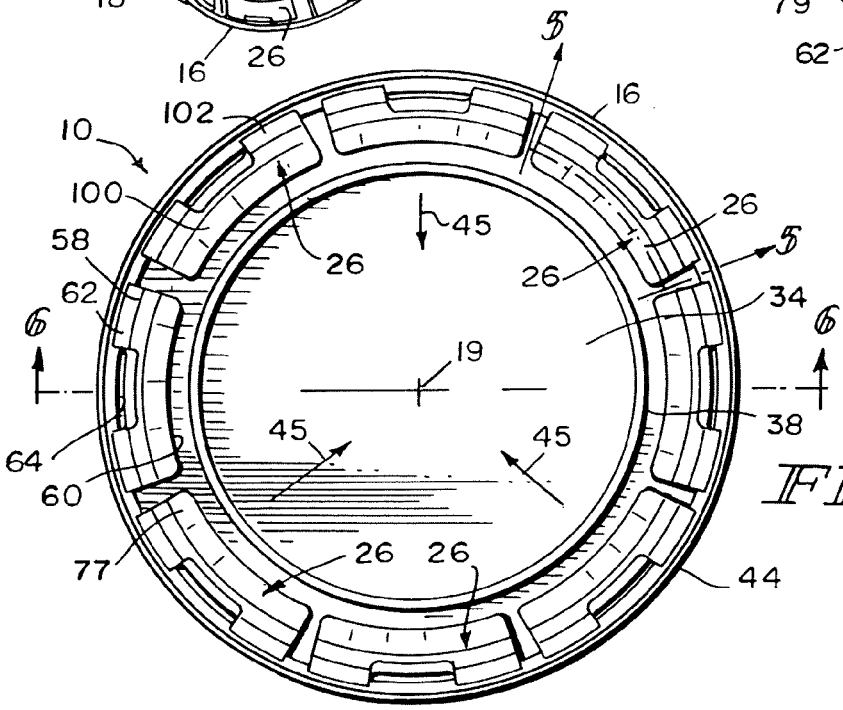
FIG. 4 is a bottom plan view of the tamper-evident closure of FIGS. 1-3 showing eight retention tabs arranged to lie in circumferentially spaced-apart relation to one another about the circular lower edge of the cap side wall.

Annular side wall 28, as best shown in the illustrative embodiments of FIGS. 1-3 and 6, includes an exterior surface 44 and an interior surface 46. Exterior surface 44 is adapted to be engaged by an operator's hand and may include a plurality of recessions 48 to assist in removal of cap 18, as shown, for example, in the illustrative embodiments of FIGS. 1-3. Interior surface 46 of side wall 28 includes a "multi-lead" thread 20, as shown in FIGS. 2 and 3. While a multi-lead thread is shown in the illustrative embodiments, it is contemplated that a continuous, two or three leaded thread is suitable. Side wall 28 of cap 18 is designed to expand when tamper-evident closure 10 is installed onto neck 24 of bottle 12 by the application of a downward force 39, as shown by arrows 39 in the illustrative embodiment of FIG. 8. Side wall 28 of tamper-evident closure 10 is also designed to expand radially outwardly 41 to allow closure 10 to eject from the mold, as shown in the illustrative embodiment of FIG. 16.

Side wall 28 of cap 18 includes an upper end 50 and a spaced-apart lower end 52. Lower end 52 of cap 18 is secured to tamper band 16 by frangible elements 22. Frangible elements 22 are formed illustratively during the molding process. Frangible elements 22 permit closure 10 to be molded as a single component but allow for the separation of cap 18 from tamper band 16 when cap 18 is removed from neck 24 of bottle 12.

Tamper band 16 of closure 10 is molded along with cap 18 and includes a top edge 54 and a spaced apart lower edge 56. Top edge 54 of tamper band 16 is secured to cap 18 by means of frangible elements 22 as shown, for example, in the illustrative embodiment of FIG. 6. Lower edge 56 of tamper band 16 includes the plurality of directionally molded retention tabs 26 that are oriented to extend in upward direction 35 and radially inward directions 45 toward axis 19 as suggested in FIGS. 4 and 6. Retention tabs 26 are spaced around a perimeter of tamper band 16 as shown, for example, in FIG. 4. Retention tabs 26 include a first end 58 that are secured to tamper band 16 by use of hinge 62. Each retention tab 26 also includes a second end 60 that forms a free end 47 of that retention tab 26, as suggested in FIG. 6. Retention tabs 26 are directionally molded in their in-use position, as shown in the illustrative embodiments of FIGS. 12-18. Each retention tab 26 is formed to include a face 100 that allows retention tabs 26 to be flexed downwardly in direction 43 to a vertical position **26*b* to allow tamper-evident closure 10 to be released from the mold, as shown, for example, in the illustrative embodiments of FIGS. 16 and 17. Once closure 10 is released from the mold, the elasticity of the plastics material causes retention tabs 26** to "snap back" to their original molded in-use position.

Figures 7, 8:
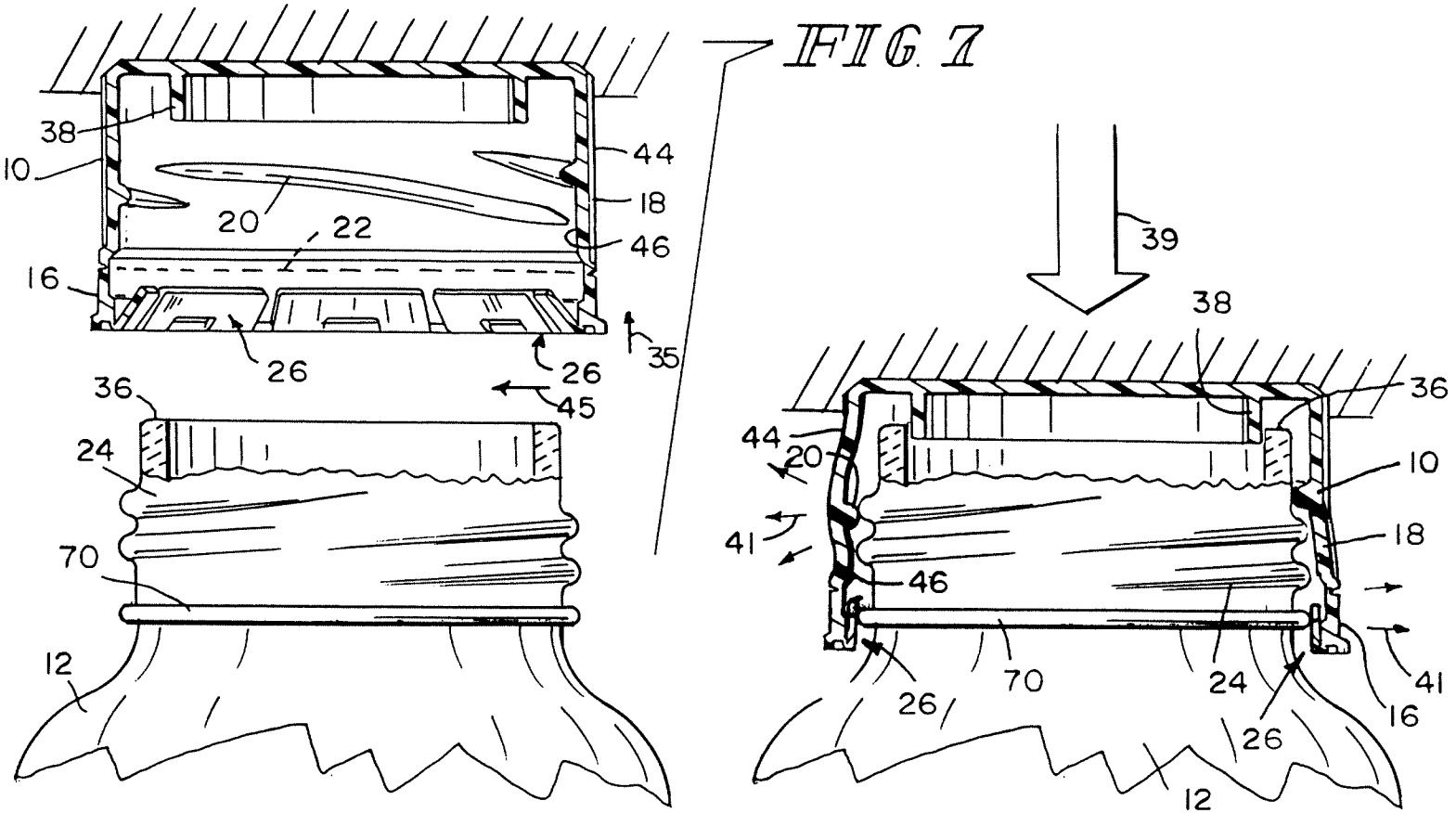
FIG. 7 is a sectional view similar to FIG. 6 showing the tamper-evident closure immediately prior to installation onto the neck of the illustrated bottle with the retention tabs of the tamper-evident closure shown in their upward and inward molded in-use position.
FIG. 8 is a sectional view similar to FIG. 7 showing the tamper-evident closure during installation of the closure onto the neck of the bottle by applying a downward force to the top of the closure, which causes the side wall of the cap to expand outwardly to allow the internal threads of the cap to clear the external threads of the bottle and also showing the retention tabs of the tamper band pivoted outwardly against the inner wall of the band so that the retention tabs "clear" the threads and annular lip of the bottle neck as the closure is moved downwardly onto the bottle.

The directional molding of retention tabs 26 allows an outward edge 68 of tabs 26 to be formed at approximately the same thickness 51 as the overall thickness of retention tabs 26, which permits a second end 60 of retention tabs 26 to engage annular lip 70 of bottle 12 with greater retention strength, as suggested by FIG. 6. This reduces the likelihood that tamper band 16 will pull off of bottle neck 24 when cap 18 is removed. Tamper-evident closure 10, of the present disclosure, is designed so that, during manufacturing, closure 10 can be attached to bottle 12 by either clockwise rotation of the closure 10 onto neck 24 of bottle 12 or by forcing tamper-evident closure 10 onto neck 24 of bottle 12 by application of a downward force 39 as shown in FIG. 8. Directionally molded retention tabs 26 can be used with either snap-on or screw-on type closures.

The retention tabs 26 depend from the tamper band 16 and are molded in their in-use position to extend toward a longitudinal axis of the tamper band 16 and toward the top wall 30 of cap 18 at a predetermined angle of inclination. Retention tabs 26 having a free end 47 adapted to engage the annular rim 70 of the container. Hinge 62 acts as a means for retaining retention tabs 26 to the tamper band 16 in their in-use position and permits retention tabs 26 to flex downwardly so that the retention tabs 26 can pivot out from beneath the mold core 76 during ejection of the closure from the mold. The hinges also allow the retention tabs 26 to automatically pivot back to their molded in-use position upon clearing the mold core 76 without requiring an intermediary manufacturing step of manually repositioning the retention tabs 26 from a flexed position to the molded in use position prior to use. While the term in-use position is used, it is contemplated that it is possible for retention tabs 26 to return to their original position or a position that is close to the molded in use position. Retention tabs 26 are secured to tamper band 16 by use of hinge 62.

Retention tabs 26 includes planar side wall or face 102, the face 102 of retention tabs 26 is adjacent hinge 62 and oriented substantially perpendicular to the inside surface of the tamper band 16 to permit retention tabs 26 to flex downwardly by reducing the interference between retention tabs 26 and the inside surface of tamper band 26. The elasticity of the plastics material used to form hinge 62 allows retention tabs 26 to flex downwardly and assists in biasing retention tabs 26 to their molded in-use position. Retention tabs have an arcuate profile, which allows retention tabs 26 to conform to the shape of the neck 24 of container 12 and assists in biasing retention tabs 26 to their molded in-use position.

The story board created by FIGS. 7 through 11 illustrate attachment and removal of tamper-evident closure 10 to and from underlying bottle 12. Tamper-evident closure is suspended above neck 24 of bottle 12 with tamper bands 16 secured to cap 18 of closure 10 as shown in FIG. 7. As can be seen molded in the illustrative embodiment of FIG. 7, directionally molded retention tabs 26 are oriented in their molded in-use positions, which are the positions retention tabs 26 are molded in during the molding process. Tamper-evident closure 10 is installed onto neck 24 of bottle 12 by the application of a downward force as suggested in FIG. 8. Downward force 39 applied to tamper-evident closure 10 causes side wall 28 and tamper band 16 to expand radially outward as shown in FIG. 8 so that retention tabs 26 and threads 20 can clear the corresponding threads of neck 24 on bottle 12. Closure 10 can also be threaded onto neck 24 of bottle 12.

Figure 11:
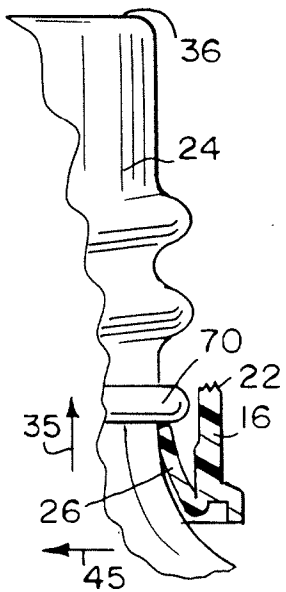
FIG. 11 is an enlarged view of the tamper band of FIG. 10 illustrating the orientation of the band and associated retention tabs with respect to the bottle neck after the cap has been separated from the band by removal of the cap from the bottle.
Figure 10:
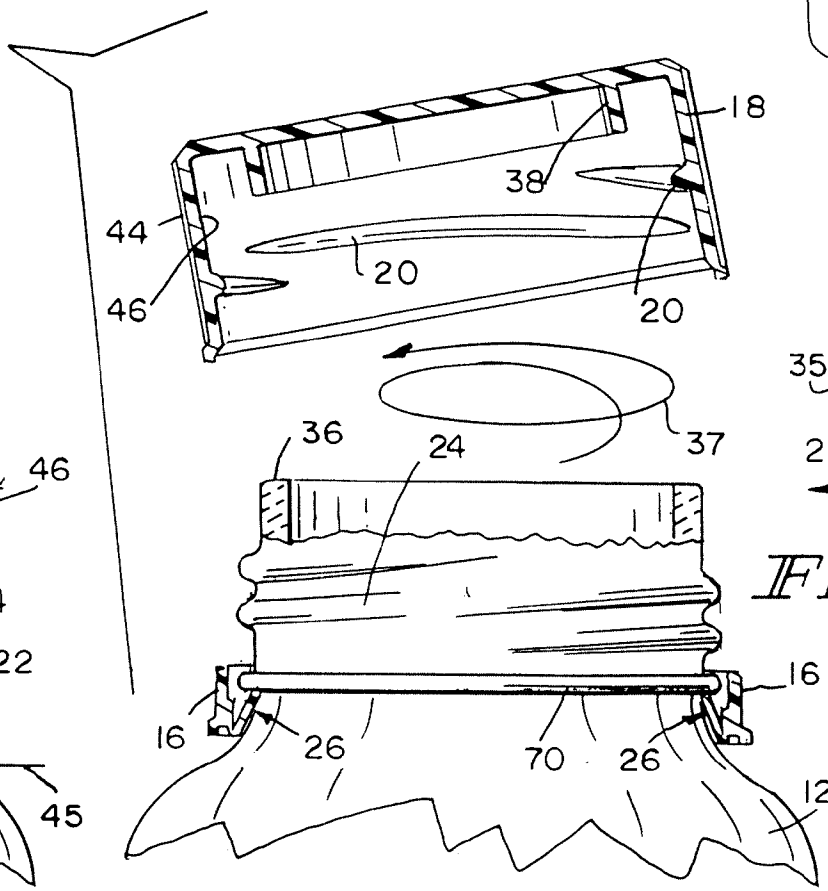
FIG. 10 is a sectional view similar to FIGS. 7-9 but with the cap removed from the bottle neck and separated from the tamper band that is left on the bottle neck by rotational movement of the cap with respect to the bottle.

Retention tabs 26 of tamper band 16 are folded in radially outward directions against interior surface 66 of tamper-evident closure 10 so that retention tabs 26 can clear the threads and annular lip 70 of bottle 12 as shown in FIG. 8. Also shown is plug 12 of top wall 30 being positioned within neck 24 of bottle 12 to seal the contents of bottle 12. Tamper-evident closure 10 after it is installed onto neck 24 of bottle 12 is shown in FIG. 9. Note that plug 38 is positioned within neck 24 of bottle 12 and that threads 20 of side wall 28 of cap 18 are engaging properly with the corresponding threads on neck 24 of bottle 12. Also note that when tamper-evident closure 10 is installed completely onto neck 24 of bottle 12, retention tabs 26 spring outward from interior surface 66 of tamper band 16 and engage an underside of annular lip 70 as shown in FIG. 9. Removal of cap 18 from neck 24 of bottle 12 is shown in FIG. 10. Frangible elements 22 are broken when cap is separated from tamper band 16. Retention tabs 26 secure tamper band 16 to bottle 12 to prevent its removal. Positioning of retention tabs 26 beneath annular lip 70 of neck 24 of bottle 12 to prevent removal of tamper band 16 from bottle 12 is shown in FIG. 11.

Molding of tamper-evident closure 10 is accomplished by using a multi-part mold 72, as shown, for example, in the illustrative embodiments of FIGS. 12 through 18. FIGS. 12 through 18 create a story board to illustrate the production of tamper-evident closure 10 by use of mold 72. Mold 72 comprises an outer core 74, an inner mold core 76, a tab sleeve 78, and a stripper 80. Inner and outer mold cores 74, 76 form inner and outer walls 55, 57 of cap 18 and tamper band 16, as suggested in FIG. 13. Retention tabs 26 are allowed to be released from beneath inner mold core 76 because of the design of the inner mold core 76, which includes a smooth rounded corner at a lower edge 86. Lower edge 86 creates a pivot point to allow retention tabs 26 to pivot from beneath inner mold core 76. Also, retention tab 16 includes a flared edge, which causes tamper band 16 to expand radially outwardly when stripper 80 imparts an upward force on tamper band 16. This creates a form of moment force on retention tabs 26, causing them to rotate about the rounded corner of inner mold core 76.

Figure 12:
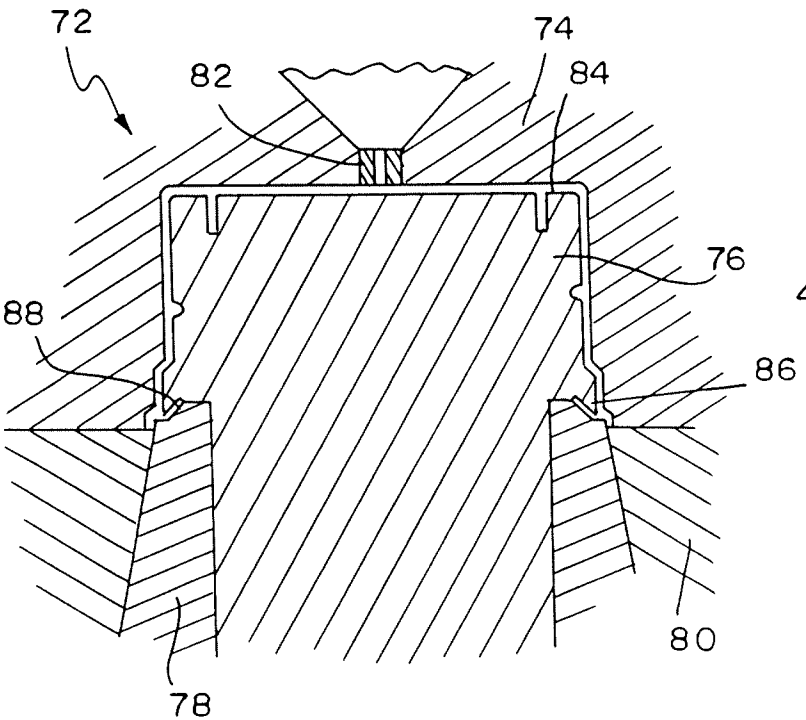
FIG. 12 is a sectional view of the multi-part mold used to form the closure illustrated in FIGS. 1-10, showing the mold prior to the injection of a plastics material into the mold and further showing tab portions of the mold oriented in an inward and upward direction.
Figure 15:
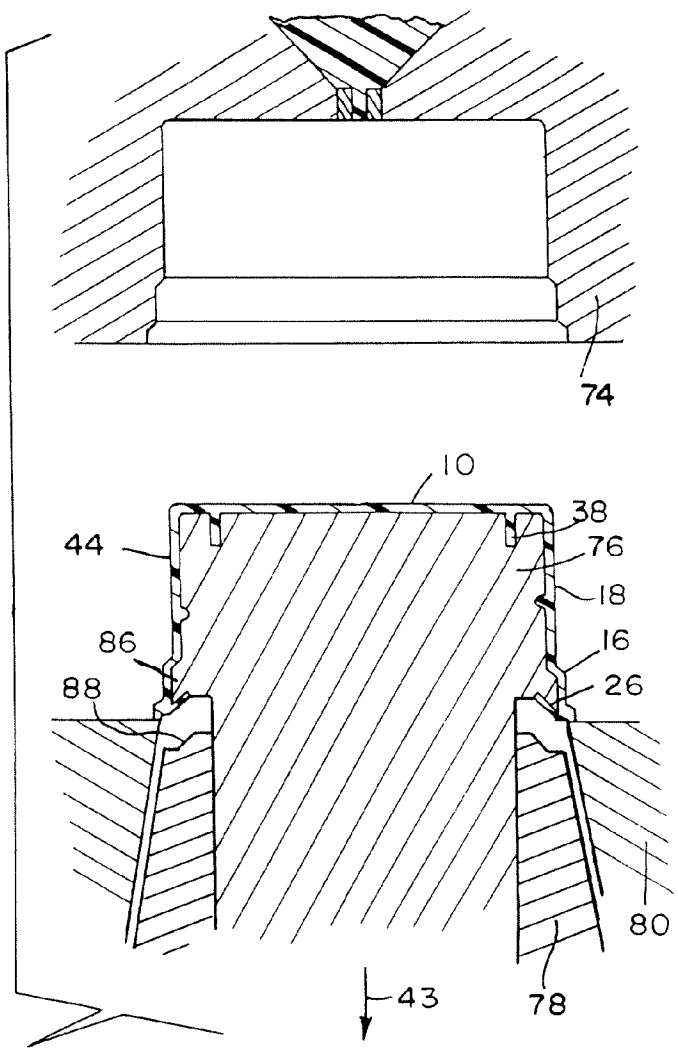
FIG. 15 is a sectional view similar to FIGS. 12-14 showing the tab sleeve of the mold retracting downward from the molded tamper-evident closure and mold core.

Outer mold core 74 includes an inlet 82 that permits plastics material to be injected into cavity 84 created by inner and outer mold cores 74, 76. Tab sleeve 78 is positioned to lie adjacent to a lower edge 86 of inner mold core 76 to create a cavity 88 to permit the forming of retention tabs 26 therein. An example of the multi-part mold core 72 prior to the injection of plastics material 90 into cavities 84, 88 created by inner and outer mold cores 74, 76 and tab sleeve 78 is shown in FIG. 12. Once multipart mold 72 is assembled properly, plastics material 90 is injected through inlet 82 to fill cavities 84, 88, as shown in the illustrative embodiment of FIG. 13. As tamper-evident closure 10 is molded, plastics material 90 flows into cavity 88 to form retention tabs 26 in their molded in-use position.

The directional molding of retention tabs 26 increases the holding force of tamper bands 16 because retention tabs 26 are in their molded in-use position when at rest. The thicker width of free end 47 of retention tabs 26 allow for more surface contact between free end 47 of retention tabs 26 and annular lip 70 on neck 24 of bottle 12. This arrangement also allows less material to contact interior surface 66 of tamper band 16. The resultant design also provides for a durable living hinge 62.

Figure 14:
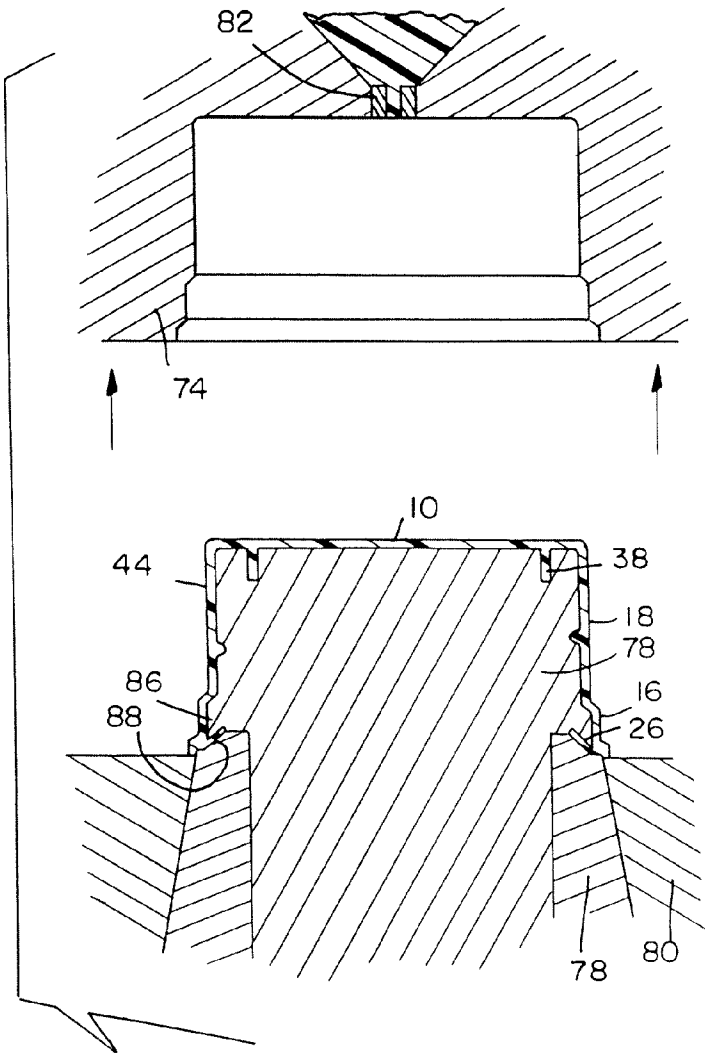
FIG. 14 is a sectional view similar to FIGS. 12 and 13 showing the upper portion of the mold retracting from the molded tamper-evident closure and mold core.

Once plastics material 90 has been injected into mold cavities 84, 88, outer mold core 74 is raised vertically off of inner mold core 76 to expose the exterior surface of tamper-evident closure 10, as shown, for example, in the illustrative embodiment of FIG. 14. Note that inner core 76, tab sleeve 78, and stripper 80 remain in their original position while outer mold core 74 is elevated. Once outer mold core 74 is elevated, tab sleeve 78 is retracted vertically downward in direction 43 away from inner mold core 76, to allow the release of retention tabs 26. Tab sleeve 78 contains all of the tab geometry to form the shape of retention tabs 26. During the ejection cycle, tab sleeve 78 is lowered to clear completely retention tabs 26 prior to the ejection of tamper-evident closure 10 from inner mold core 76, which ensures that tab sleeve 78 does not contact molded retention tabs 26 when tabs 26 are released from inner mold core 76.

Proper mold geometry is important in order to ensure that retention tabs 26 and closure 10 properly clear the mold during ejection of closure 10. Tab sleeve 78, which forms part of the mold 72, includes all of the tab geometry to form the lower portion of retention tabs 26. Inner mold core 76 has a smooth exterior surface and includes a lower edge 86 having a corner radius that is from about 0.005 inch (0.0127 cm) to about 0.008 inch (0.0203 cm) to ensure that retention tabs 26 do not shear off during ejection of tamper-evident closure 10 from mold 72. The corner radius ensures that the retention tabs 26 can pivot around lower edge 86 of inner mode core 76 without shearing hinge 62 of retention tabs 26. Retention tabs 26 include at least a 0.010 inch (0.0254 cm) plastic overlap beyond the outer diameter of inner mold core 76 to allow retention tabs 26 to stretch and pivot around lower edge 86 to prevent retention tabs 26 from shearing off during ejection. The overlap of plastics material formed at hinge 62 ensures that hinges 62 have elastic deformation during ejection. The elastic deformation of the plastics material in hinge 62 causes retention tabs 26 to pivot back to their original state of molding after ejection of closure 10 from mold 72. Not enough elasticity in the plastics material and retention tabs 26 will not pivot back to their molded position after ejection.

The tamper band 16 of closure 10 is flared outwardly at lower edge 56. The flared lower edge 56, when engaged by stripper 80, causes the tamper band 16 and side wall 28 to flex outwardly and pivot upwardly when the stripper 80 moves closure 10 in an upward direction. Stripper 80 engages the flared edge 56 of tamper band 16 creating a moment force on the tab, which causes the retention tabs 26 pivot from beneath mold core 76 and flex downwardly to release position 26*b*. Retention tabs 26, of tamper band 16, when in the in-use position have a first face 100 that forms an outer surface of the tabs 26. First face 100 is oriented at approximately 40 degrees from vertical when tabs 26 are in their in-use position. Retention tabs 26 also include a second face 102 that is adjacent first face 100 and is substantially perpendicular to side wall 28 of cap 18 when tabs 26 are in their in-use position, as shown, for example, in FIG. 4. Second face 102 is positioned adjacent to first face 100 along a common edge and inclined at an angle that is acute to first face 100. Second face 102 reduces the interference between retention tabs 26 and an interior surface of tamper band 16. Second face 102 is adjacent hinge 62 and provides clearance so tabs 26 can pivot downward to clear the mold without exceeding the elastic limit of the plastics material. The curved shape of retention tabs 26 prevents the tamper band 16 from becoming deformed into a polygon shape such as a octagon or decagon and assist in biasing retention tabs 26 to their original molded position when closure 10 is released from the mold.

Figures 16, 17, 18:
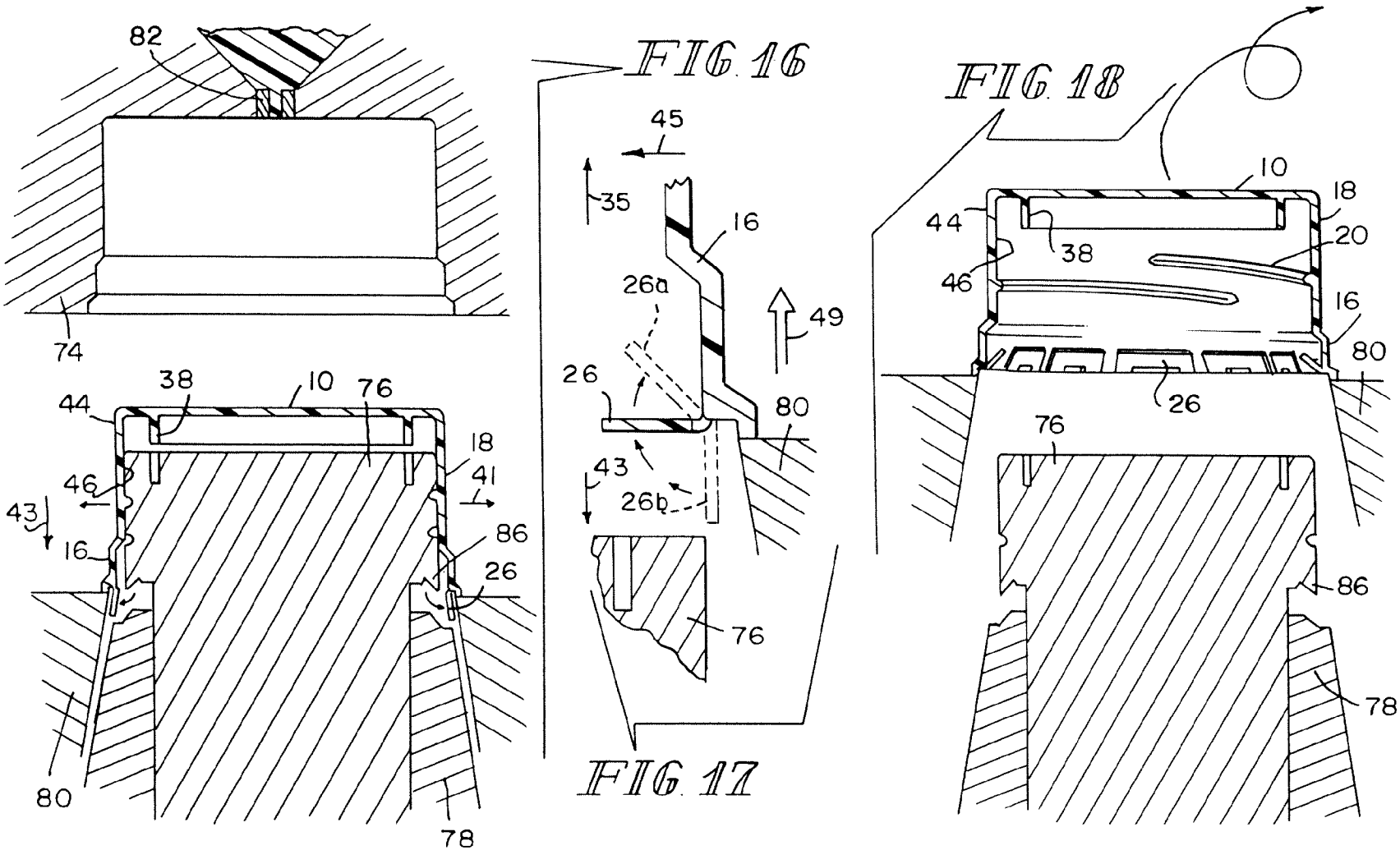
FIG. 16 is a sectional view similar to FIGS. 12-15 showing the stripper engaging the outer perimeter of the closure and raising the closure vertically upward off of the mold core, which forces the tabs to pivot downwardly from their molded in-use positions to clear the bottom portion of the mold core and further showing the wall of the cap expanding outward from the mold to clear the threads of the mold core.
FIG. 17 is an enlargement of a stripper/closure interface of FIG. 16 showing movement of the retention tab after the closure has been cleared of the mold core, with the movement of the retention tab indicated by the phantom lines and arrows.
FIG. 18 is a sectional view similar to FIGS. 12-16 showing the closure after it has been ejected from the mold core with the retention tabs automatically retracted back to their molded in-use positions.

Once tab sleeve 78 is retracted from inner mold core 76, stripper 80 elevates to separate tamper-evident closure 10 from inner mold core 76. Two events occur when the closure 10 is separated from inner mold core 76. First, retention tabs 26 of closure 10 are flexed downwardly and outwardly from their molded in-use positions to flexed removal positions 26*b* so that retention tabs 26 can clear the lower edge 86 of inner mold core 76 as shown in FIG. 17. Movement of tabs 26 from beneath inner mold core 76 is caused by the outward and upward movement of tamper band 16. Outward movement of tamper band 16 causes a moment force on retention tabs 26, causing them to pivot downwardly.

Flexing of retention tabs 26 is a temporary condition and once retention tabs 26 clear inner mold core 76 they return automatically (snap back) to their molded in-use positions, as shown in the illustrative embodiment of FIG. 17. Retention tabs 26 are elastic and flexing the tabs 26 to release closure 10 from inner mold core 76 does not exceed the elastic limit of the plastics material. Hence, once the closure 10 is released from the inner mold core 76, the elasticity of the plastics material and curved profile of tabs 26 causes retention tabs 26 to snap back to their molded in-use position 26*a*. Closure 10, shown in FIG. 17, is moving in the direction of arrow 49. Ghost line 26*a* illustrates retention tabs 26 in an upward 35 and inward 45 direction. Ghost line 26*b* illustrates retention tabs 26 in a downward 43, flexed position. Secondly, side wall 28 of cap 18 and tamper band 16 expand outwardly to clear inner mold core 76. Tamper-evident closure 10 is shown in FIG. 18 after closure 10 has been ejected from inner mold core 76 and retention tabs 26 have pivoted automatically back to their molded in-use positions.

In use, tamper-evident closure 10 can be secured to neck 24 of bottle 12 or other container by either rotating closure 10 onto neck 24 of bottle 12 or by press fitting closure 10 into position. Installation of closure 10 occurs during manufacturing subsequent to the filling of bottle 12. Once tamper-evident closure 10 is installed onto neck 24 of bottle 12, retention tabs 26 are positioned firmly beneath annular lip 70 of neck 24 of bottle 12. After tamper-evident closure 10 has been installed on bottle 12, removal of cap 18 causes the breakage of frangible elements 22 between cap 18 and tamper band 16. Rotation of cap 18 causes cap 18 to move vertically upward away from tamper band 16. The position of tamper band 16 with respect to neck 24 of bottle 12 remains substantially unchanged during the removal of cap 18 from neck 24 because retention tabs 26 retain band 16 to neck 24 of bottle 12. Since tamper band 16 cannot move vertically with respect to cap 18, frangible elements 22 break, releasing cap 18 from tamper band 16. Once cap 18 has been removed, if it is subsequently reinstalled, it will be apparent to an end-user that cap 18 has been removed previously from bottle 12.

The invention claimed is:

1. A tamper evident container closure formed from a plastics material in a mold having a mold core, the closure adapted for use with a container having a neck, the neck including an annular rim extending around the circumference of the neck, the container closure comprising a cap having a top wall and an annular side wall, the side wall including a top edge appended to the top wall and a bottom edge positioned to extend away from the top wall, the annular side wall including means for engaging the neck of the container, a tamper band having a bottom edge and a spaced apart top edge appended to the bottom edge of the side wall by a plurality of frangible elements, the tamper band comprising a flared lower edge that causes the tamper band to expand during ejection from the mold core, a plurality of retention tabs depending from the tamper band, the retention tabs being molded in their in-use position to extend toward a longitudinal axis of the tamper band and toward the top wall of the cap at a predetermined angle of inclination, the retention tabs having a free end adapted to engage the annular rim of the container, and retainer means for retaining the retention tabs to the tamper band in their in-use position and to permit the retention tabs to flex downwardly so that the retention tabs can pivot out from beneath the mold core during ejection of the closure from the mold and automatically pivot back to the molded in-use position upon clearing the mold core without requiring an intermediary manufacturing step of manually repositioning the retention tabs from a flexed position to the molded in use position prior to use.

2. The closure of claim 1, wherein the retainer means includes a hinge coupled to the tamper band to permit the hinge to flex downwardly from the in use position.

3. The closure of claim 1, wherein the retainer means includes a hinge and planar side wall, the side wall of the retention tabs is adjacent the hinge and oriented substantially perpendicular to the inside surface of the tamper band to permit the retention tabs to flex downwardly by reducing the interference between the retention tabs and the inside surface of the tamper band.

4. The closure of claim 2, wherein the hinge is constructed of a material having an elasticity to allow the retention tabs to flex downwardly and return to their molded in-use position.

5. The closure of claim 1, wherein the retention tabs are formed to include an arcuate inner edge configured to provide means to conform to the neck of the container.

6. The closure of claim 1, wherein the retention tabs are molded at approximately a 40 degree angle from vertical.

7. The closure of claim 1, wherein the outer edge of the retention tabs has a thickness that is about equal to a maximum thickness of the retention tabs.

8. A tamper evident container closure formed from a plastics material in a mold having a mold core, the closure adapted for use with a container having a neck, the neck including an annular rim extending around the circumference of the neck, the container closure comprising a cap having a top wall and an annular side wall, the side wall including a top edge appended to the top wall and a bottom edge positioned to extend away from the top wall, the annular side wall including means for engaging the neck of the container, a tamper band having a bottom edge and a spaced apart top edge appended to the bottom edge of the side wall by a plurality of frangible elements, the tamper band comprising a flared lower edge that causes the tamper band to expand during ejection from the mold core, a plurality of retention tabs depending from the tamper band, the retention tabs being molded in their in-use position to extend toward a longitudinal axis of the tamper band and toward the top wall of the cap at a predetermined angle of inclination, the retention tabs having a free end adapted to engage the annular rim of the container, and hinges retaining the retention tabs to the tamper band in their in-use position, the hinges being constructed of a material having an elasticity to permit the retention tabs to flex downwardly so that the retention tabs can pivot out from beneath the mold core during ejection of the closure from the mold and automatically pivot back to the molded in-use position upon clearing the mold core without requiring an intermediary manufacturing step of manually repositioning the retention tabs from a flexed position to the molded in use position prior to use.

9. The closure of claim 8, wherein each said retention tab includes a planar side wall adjacent one of the hinges and oriented substantially perpendicular to the inside surface of the tamper band to permit each said retention tab to flex downwardly by reducing the interference between each said retention tab and the inside surface of the tamper band.

10. The closure of claim 8, wherein the retention tabs are formed to include an arcuate inner edge configured to provide means to conform to the neck of the container.

11. The closure of claim 8, wherein the retention tabs are molded at approximately a 40 degree angle from vertical.

12. The closure of claim 8, wherein an outer edge of the retention tabs has a thickness that is about equal to a maximum thickness of the retention tabs.

13. A tamper evident container closure formed from a plastics material in a multi-part mold having an outer mold core, an inner mold core and a tab sleeve, wherein the inner and outer mold cores in combination with the tab sleeve form a mold cavity, the closure adapted for use with a container having a neck including an annular rim extending around the circumference of the neck, the container closure comprising a cap formed between the inner and outer mold cores, the cap including a top wall and an annular side wall having a top edge appended to the top wall and a bottom edge positioned to extend downwardly away from the top wall, the annular side wall including means to engage the neck of the container, a tamper band formed between the inner and outer mold cores, the tamper band including a bottom edge and a spaced apart top edge appended to the bottom edge of the side wall by a plurality of frangible elements, a plurality of retention tabs formed between the tab sleeve and inner mold core, the retention tabs depend from the tamper band and are molded in their in-use position and extend inward toward a vertical axis of the closure and toward the top wall of the cap at a predetermined angle of inclination, the retention tabs adapted to engage the annular rim of the container, hinges formed between the tab sleeve and inner mold core, the hinges flexibly secure the retention tabs to the tamper band so that the retention tabs can flex downwardly when the closure is being released from the mold core during ejection of the closure, the hinges define a means for causing the retention tabs to pivot back automatically to the molded in-use position upon release of the closure from the inner mold core without requiring any intermediary manufacturing step to mechanically reposition the retention tabs prior to installing the closure onto the container, and wherein the tamper band comprises a flared outer edge that is configured to provide means for engaging a stripper so that the tamper band expands radially outwardly during ejection from the inner mold core and includes means for ensuring that the retention tabs pivot around the lower edge during removal of the closure from the inner mold core without shearing the retention tabs from the tamper band.

14. The closure of claim 13, wherein the inner mold core includes a smooth outer surface and a lower edge positioned adjacent the retention tabs and has a corner radius from about 0.005 inches to about 0.008 inches to allow the retention tabs to pivot around the lower edge during removal of the closure from the inner mold core without shearing the retention tabs from the tamper band.

15. The closure of claim 13, wherein the hinge is constructed of a material having an elasticity to allow the retention tabs to flex downwardly and return to their molded in-use position.

* * * * *